US005608507A

United States Patent [19]

Nguyen

[11] Patent Number: 5,608,507

[45] Date of Patent: Mar. 4, 1997

[54] DIRECT TRANSFER OF LIQUID TONER IMAGE FROM PHOTOCONDUCTOR DRUM TO IMAGE RECEIVER

[75] Inventor: Khe C. Nguyen, Los Altos, Calif.

[73] Assignee: Hewlett-Packard Company, Palo Alto, Calif.

[21] Appl. No.: 522,681

[22] Filed: Sep. 1, 1995

[51] Int. Cl.[6] ..... G03G 15/16; G03G 13/16

[52] U.S. Cl. ..... 399/307; 430/126; 399/318

[58] Field of Search ..... 355/211, 256, 355/273, 279; 430/60, 66, 126

[56] References Cited

U.S. PATENT DOCUMENTS

| | | | |
|---|---|---|---|
| 4,023,967 | 5/1977 | McGibbon | 355/211 |
| 4,600,673 | 7/1986 | Hendrickson et al. | 430/66 |
| 4,927,727 | 5/1990 | Rimai et al. | 430/99 |
| 4,968,578 | 11/1990 | Light et al. | 430/126 |
| 5,037,718 | 8/1991 | Light et al. | 430/126 |
| 5,043,242 | 8/1991 | Light et al. | 430/126 |
| 5,045,424 | 9/1991 | Rimai et al. | 430/126 |
| 5,115,277 | 5/1992 | Camis | 355/279 |
| 5,284,731 | 2/1994 | Tyagi et al. | 430/126 |

*Primary Examiner*—Joan H. Pendegrass

[57] ABSTRACT

High efficiency transfer of liquid toner image from an photoconductor onto an image receiver (e.g., plain paper, transparency film, and the like) using a simple and direct, one-step process, is provided. The transfer is effected using a hard (non-conformable) substrate, at least one conformable intermediate mat, the photoconductor having a release surface comprising a siloxane, the image receiver, a roller, and a source of heat and pressure. One conformable layer may be employed, resulting in two possibilities. In the first possibility, the roller comprises the source of heat and pressure and the conformable layer supports the photoconductor layer. A non-conformable layer supports the conformable layer. In the second possibility, the source of heat and pressure is on that surface of the photoconductor opposite that on which the toner image is carried and the conformable layer is positioned between the roller and the image receiver. In yet another embodiment, two conformable layers are employed, with a first conformable layer supporting the photoconductor layer and a second conformable layer positioned between the roller and the image receiver, with a non-conformable layer supporting the first conformable layer. The roller provides the source of heat and pressure.

26 Claims, 2 Drawing Sheets

DIRECT TRANSFER OF LIQUID TONER IMAGE FROM PHOTOCONDUCTOR DRUM TO IMAGE RECEIVER

TECHNICAL FIELD

The present invention relates generally to image transfer technology and, more particularly, to electrophotography, employing a photoconductor material, wherein an image derived frown a liquid toner is transferred to an image receiver.

BACKGROUND ART

Electrophotographic laser printing technology employs a toner containing pigment components and thermoplastic components for transferring a latent image formed on selected areas of the surface of an insulating, photoconducting material to an image receiver, such as plain paper, coated paper, transparent substrate (electrically conducting or insulative), or an intermediate transfer medium.

There is a demand in the laser printer industry for multicolored images. Responding to this demand, designers have turned to liquid toners, with pigment components and thermoplastic components dispersed in a liquid carrier medium, usually special hydrocarbon liquids. With liquid toners, it has been discovered that the basic printing color (yellow, magenta, cyan, and black) may be applied sequentially to a photoconductor surface, and from there to a sheet of paper or intermediate transfer medium to produce a multi-colored image.

Direct transfer of images from toner on the photoconductor drum to the image receiver is well-known in the an of conventional dry electrostatic printing. In such an approach, electrostatic forces attract the toner to the drum from the toner source, and subsequent electrostatic forces on the image receiver are stronger than the adhesion of the toner to the drum, and thereby attract the toner to the image receiver, where it is subsequently fused.

However, under certain conditions, such as when the surface of the final image receiver (plastic, rubber, coated paper, plain paper, and the like) is too rough to provide enough contact between the toner layer and the image receiver surface or when the particle size of the toner is too fine to be efficiently transferred electrostatically, then the image transfer efficiency is reduced. To address these problems, intermediate transfer procedures have been developed in electrophotography. Such intermediate transfer procedures are used to improve the image transfer efficiency.

Poor transfer occurs when (1) the surface of the image receiver is too rough, as noted above, (2) the particle size is less than 3 μm, such as the case of liquid developer, and (3) a film-forming liquid toner is used, especially when a dried image is made of the liquid toner (a film-forming toner is a toner having a high polymeric binder content).

In indirect transfer, the toner image is transferred by an electric field or by a thermally-assisted pressure transfer (not requiting a transfer bias) into an intermediate surface and then from the intermediate surface into the final image receiver (plain paper, plastic transparency, coated paper, and the like). Thus, the transfer promotion driving forces can be (1) an electric field, (2) a heat source, (3) a pressure source, and (4) a pressure aid (for example, a stickier image receiver will pick up the toner better).

The advantage of indirect transfer is a significant improvement of transfer efficiency when the transfer condition is not well-established, under the conditions outlined above. However, the disadvantages of indirect transfer are that (1) it adds another step, thereby complicating the imaging process, which can reduce the reliability of the imaging process, since the step involving the intermediate materials requires additional considerations as to process, life, and maintenance of the intermediate materials, (2) it is more expensive, and (3) that the transfer efficiency can be reduced with increased transfer steps.

To avoid the disadvantages of indirect transfer and to deal with the problems of smaller particle sizes of the toner, non-electrostatic transfer methods have been developed. For example, in thermally-assisted transfer (with possibly electrostatically-assisted transfer), the image receiver is heated, typically to a temperature within the range of about 60° to 90° C. and is pressed against the toner particles. The toner particles are fused to each other at the point of contact, but are not melted. Examples of this process are disclosed in, e.g., U.S. Pat. No. 4,927,727, issued to Rimai et at, U.S. Pat. No. 4,968,578, issued to Light et al, U.S. Pat. No. 5,037,718, issued to Light et at, and U.S. Pat. No. 5,284,731, issued to Tyagi et at. In each reference, dry toner is employed, typically having a particle size of less than 8 μm (or less than 5 μm) and a specially-coated image receiver (paper) is used.

In the thermally-assisted, direct transfer, the image receiver may be overcoated with a thermoplastic. The toner particles are embedded into the image receiver. An example of this process is disclosed in, e.g., above-mentioned U.S. Pat. No. 4,927,727.

Many variations of the foregoing thermally-assisted direct transfers are also known. For example, above-mentioned U.S. Pat. No. 5,037,718, U.S. Pat. No. 5,043,242, issued to Light et at, and U.S. Pat. No. 5,045,424, issued to Rimai et at, disclose selective polymer resins for the photoconductor surface and the image receiver without using release to achieve thermally-assisted transfer. Above-mentioned U.S. Pat. No. 5,284,731 employs heat plus an electric field, with no over-coated receiver. This is an electrostatically-assisted thermal transfer process that enables utilization of a reduced transfer temperature. The lower temperature and pressure requirements in turn lead to a reduction in "ghost" images.

The heat employed in these processes is sufficient to cause the toner particles to adhere at the point of contact, i.e., to fuse together, without melting, or flowing to form a single mass. The image receiver may be pre-heated, but it is important to avoid overheating, as this will result in reduced transfer efficiency.

Above-mentioned U.S. Pat. No. 5,037,718 is particularly relevant. This reference discloses a method for non-electrostatically transferring dry toner particles which comprise a toner binder and have a particle size of less than 8 μm from the surface of an element which has a surface layer comprising a film-forming electrically insulating polyester or polycarbonate thermoplastic polymeric binder/resin matrix and a surface energy of not greater than about 47 dynes/cm, preferably about 40 to 45 dynes/cm, to a receiver which comprises a substrate having a coating of a thermoplastic condensation polymer on a surface of the substrate in which the glass transition temperature, $T_g$, of the polymer is less than about 10° C. above the $T_g$ of the toner binder and the surface energy of the thermoplastic polymer coating is about 38 to 43 dynes/cm by contacting the toner particles with the receiver which is heated to a temperature such that the temperature of the thermoplastic polymer coating on the receiver substrate during transfer is at least about 5° C. above the $T_g$ of the thermoplastic binder, whereby virtually all of the toner particles are transferred from the surface of the element to the thermoplastic polymer coating on the receiver substrate and the thermoplastic coating is prevented from adhering to the element surface during transfer in the absence of a layer of a release agent on the thermoplastic polymer coating or the element. After transfer, the receiver is separated from the element while the temperature of the thermoplastic polymer coating is maintained above the $T_g$ of the thermoplastic polymer. The method is said to be provide images having high resolution and low granularity from very small size toner particles. However, this method must use a specially coated receiver to enhance the transfer efficiency, so it limits the use of the method for making images on plain paper.

Liquid toner tends to comprise particles even smaller than those of the dry toner disclosed in the above-discussed references, typically on the order of 1 μm and less. It would seem at first blush that the methods used for depositing dry toner having relatively small toner size (<8 μm) could be used with liquid toner.

However, the office environment requires non-toxic, non-hazardous materials. The conventional liquid toning process provides the hard copies having carded out liquids which are no longer acceptable in the office environment. For example, in the so-called Benny Landa process, with reference to the E-1000 electrophotographic printer, liquid toner is used, having a small particle size on the order of less than 1 μm. The transfer of toner is performed electrostatically, using the liquid toner, which puts liquid onto the paper, requiring drying after the transfer. The drying operation results in vapor emitted into the atmosphere, making this process unsuitable for office environments, due to toxicological concerns.

Thus, it is necessary to dry out the liquid from the toner imaging before the toner can be tranferred into the final image receiver (paper, plastic film, and the like). However, there are many problems involved, which make the transfer of a dried liquid toner image into another image receiver, or print medium, more difficult due to the following reasons:

(a) the adhesive force between the toner and the photoconductor surface becomes stronger when the particle size becomes smaller, especially at sizes below 1 μm;

(b) furthermore, that adhesive force even becomes stronger when the liquid carrier is eliminated or minimized;

(c) the liquid toner particles tend to lose the charge when the liquid carrier is removed; and (d) some image receivers, such as plain paper, exhibit a very rough surface, and reduce the contact between the image carrying toner and the paper surface, thereby reducing the image transfer efficiency.

Thus, there remains a need for a direct, one-step transfer of liquid toner from the photoconductor drum to an image receiver that can comprise materials other than specially coated papers. The direct transfer must be performed in a manner that will be acceptable in office environments and that overcomes the adhesive force problems listed above.

DISCLOSURE OF INVENTION

In accordance with the invention, a direct, one-step transfer of liquid toner image from a photoconductor onto an image receiver is provided. The image receiver is not limited to a specially coated substrate, and may comprise, for example, plain paper, plastic film, etc. The image is dry-transferred onto the image receiver without liquid; this is accomplished by removing the liquid carrier from the toner prior to the transfer process. The adhesive problems are overcome by use of a release layer on the photoconductor surface, and the use of the smaller (<1 μm) particles associated with liquid toner results in greater adherence of the image on the image receiver.

The transfer of the present invention is effected using (1) a hard (non-inconformable) substrate, (2) at least one conformable intermediate mat, (3) a photoconductor layer having a release surface thereon to provide the photoconductor layer with a surface energy of less than 40 dynes/cm, (4) the image receiver, (5) a source of heat and pressure, and (6) a roller, as described herein. Specifically, the apparatus of the invention comprises:

(a) the photoconductor layer having the release layer thereon;

(b) a roller spaced from the photoconductor layer;

(c) means for directing the image receiver between the photoconductor layer and the roller such that the image receiver contacts both the release layer and the roller;

(d) at least one conformable layer, supporting the photoconductor layer and the image receiver thereon; and (e) a source of heat and pressure against the image receiver for transferring the image to the image receiver.

As indicated above, the invention depends on a surface energy of less than 40 dynes/cm, which is provided by the class of the polydimethylsiloxane and perfluoro alkyl polymer derivatives. The invention further employs with the film-forming toner a binder having a $T_g$ in the range of about −10° to 60° C.

The supporting conformable layer has compliant properties. By "compliant properties" is meant that the viscoelasticity of the supporting means allows a minimal distance between the toner image and the image receiver when a pressure is applied between the image doner and the image receiver. The compliant properties also assure a maximum contact of two components in the transfer process. The compliant material must be sandwiched between two pressure rollers, and can be located on either the back side of the image receiver or the back side of the photoconductor web.

The source of heat is constrained to provide a constant heating within the temperature range of about 110° to 120° C. at the transfer nip, and the source of pressure is constrained to provide a constant pressure of about 115 to 120 psi at the transfer nip.

By employing the foregoing components in concert, any image receiver having a rough surface, such as plain paper or newsprint, can be used to receive images to achieve a substantially complete (e.g., essentially 100%) transfer of toner. Even image receivers having smooth surfaces may be printed using the apparatus of the invention, so long as the $T_g$ of the image receiver is at least 50° C.

The apparatus of the invention permits high efficiency transfer, i.e., essentially 100%, using a simple and direct one-step process, thereby overcoming the problems associated with the prior art approaches to transferring liquid toner images to an image receiver. Removal of the liquid carrier prior to the transfer process enables the apparatus to be used in office environments, thereby eliminating toxicology concerns.

BEST MODES FOR CARRYING OUT THE INVENTION

Figure 1A:
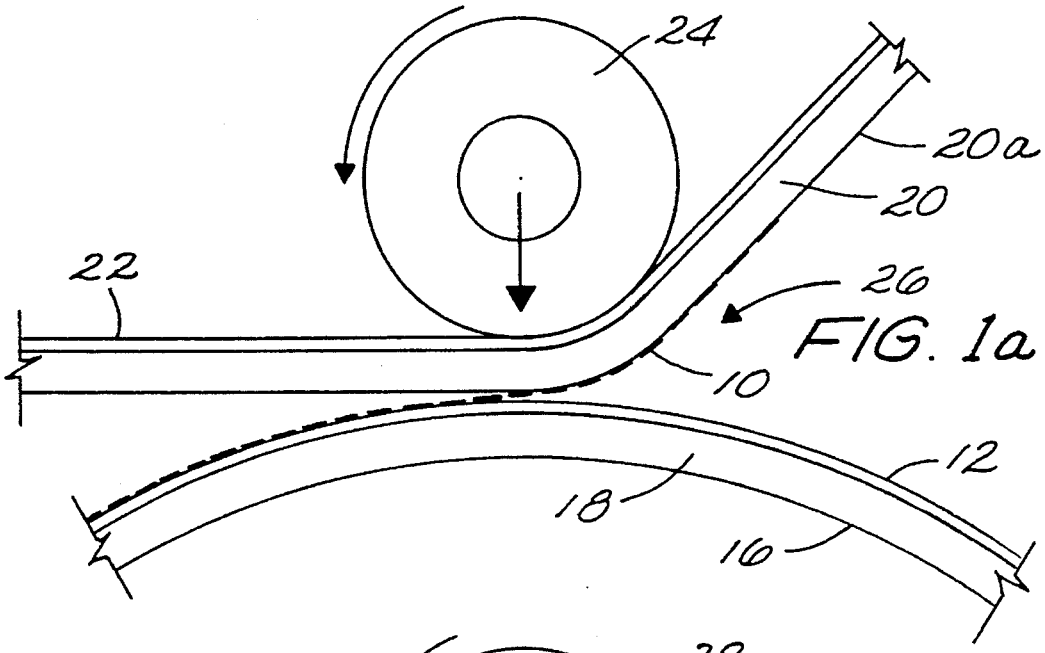
FIG. 1*a* is a side elevational view, in section, depicting the first step in a prior art two-step process of transferring a liquid toner image to a print medium.
Figure 1B:
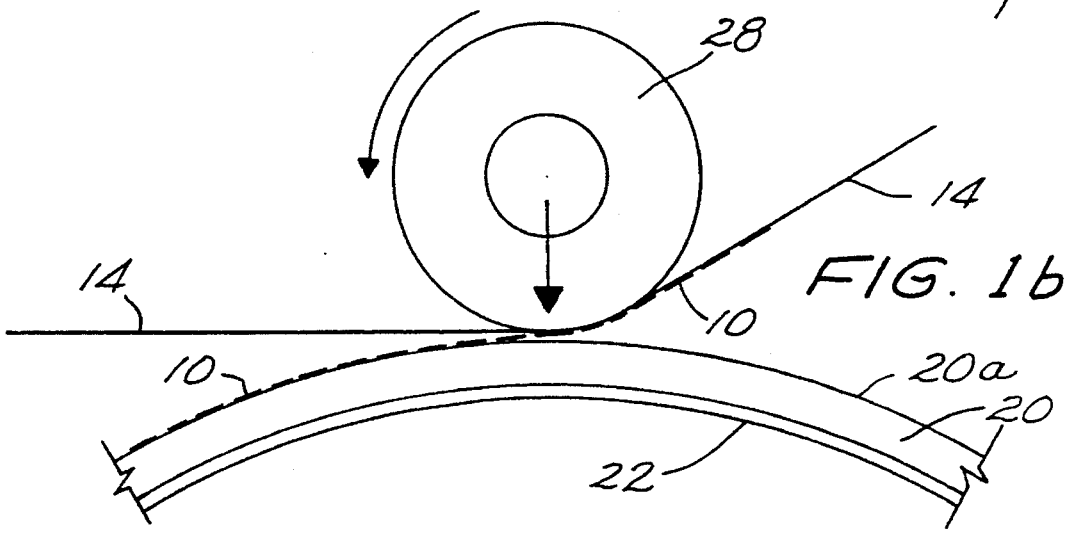
FIG. 1*b* is a side elevational view, in section, depicting the second step in the prior art two-step process of transferring the liquid toner image to the print medium.

Referring now to the drawings wherein like numerals of reference designate like elements throughout, FIGS. 1*a–b* depict a prior art two-step process for transferring liquid toner 10 from a release surface 12 to a print medium, or image receiver, 14. As shown in FIG. 1*a*, the toner 10 is first transferred from the release surface 12, which is formed on the outer surface of an electrophotographic drum 16 having a photoconductor (PC) coating 18 thereon, to the surface 20*a* of a conformable carrier layer 20. The conformable carrier layer 20 provided with a layer 22 of an intermediate transfer material. Both the conformable carrier layer 20 and the intermediate transfer layer 22 are moved past a pressure roller 24 to transfer the toner 10 to the surface 20*a* of the conformable carrier layer 20. The conformable carrier layer 20 and the intermediate transfer layer 22 supported thereon are transported through the nip 26 formed by the photoconductor drum 16 and the pressure roller 24, with the conformable carrier layer in contact with the photoconductor layer 18 and the intermediate transfer layer in contact with the pressure roller.

The transfer from the release layer 12 to the conformable carrier layer 20 depends on the relative adhesion forces involved. If F1 is the adhesion force between the toner 10 and the release layer 12 and if F2 is the adhesion force between the conformable carrier layer 20 and the toner 10, then the transfer will occur so long as F2 is greater than F1.

As shown in FIG. 1*b*, the toner 10 is transferred to from the conformable surface 20 to the paper 14 by the aid of a heat and pressure roller 28. As in FIG. 1*a*, the transfer depends on the relative adhesion forces involved. If F3 is the adhesion force between the paper 14 and the toner 10, then the transfer will occur so long as F3 is greater than F2.

Thus, it will be appreciated by those skilled in this art that the prior art process depicted in FIGS. 1*a–b* require that F3>F2>F1.

In accordance with the present invention, a simple, direct, one-step process onto paper is provided. Toner is transferred onto the surface of the photoconductor substrate by first removing the liquid carrier; this minimizes the amount of liquid transferred to the image receiver. While there are many ways well-known in the art for removing most or all of the liquid carrier from the toner, one preferred way is to use a squeeze roller as the toner is taken up from the toner reservoir; the liquid is then returned to the toner reservoir. Such methods are known in the art and hence are not illustrated here.

Figure 2:
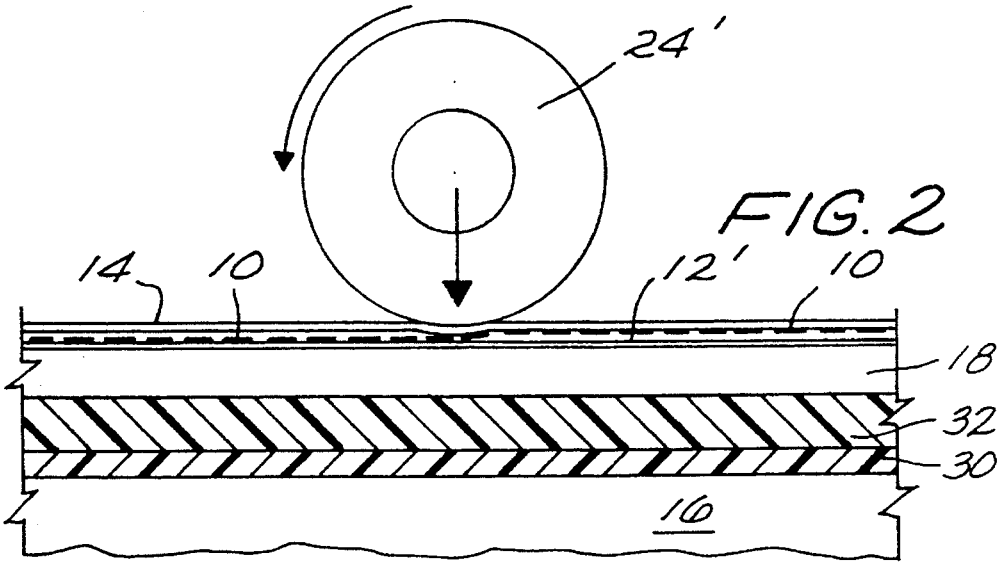
FIG. 2 is a side elevational, in section, depicting one embodiment of apparatus useful in the practice of the direct, one-step process of the present invention for transferring a liquid toner image to a print medium.

One embodiment of the apparatus of the invention is depicted in FIG. 2, which utilizes a photoconductor drum 16 on which is formed a first non-conformable substrate 30, a conformable layer 32, and the PC layer 18, provided with a release surface 12'. The back of the paper 14 is contacted by a heat and pressure roller 24', which transfers the toner image 10 (after removal of the liquid carrier) directed to the paper by the combination of heat and pressure.

The pressure employed is preferably in the range of 110 to 120 psi (7.7 to 8.4 Kg/cm$^2$), while the temperature employed is preferably in the range of 115° to 120° C. If there is insufficient pressure or temperature, there will be no transfer of the image. If the pressure exceeds about 120 psi, it may destroy the image 10, while if the temperature exceeds about 120° C., it may cause melting of the toner 10 and consequent sticking of the paper to the PC layer 18.

Figure 3:
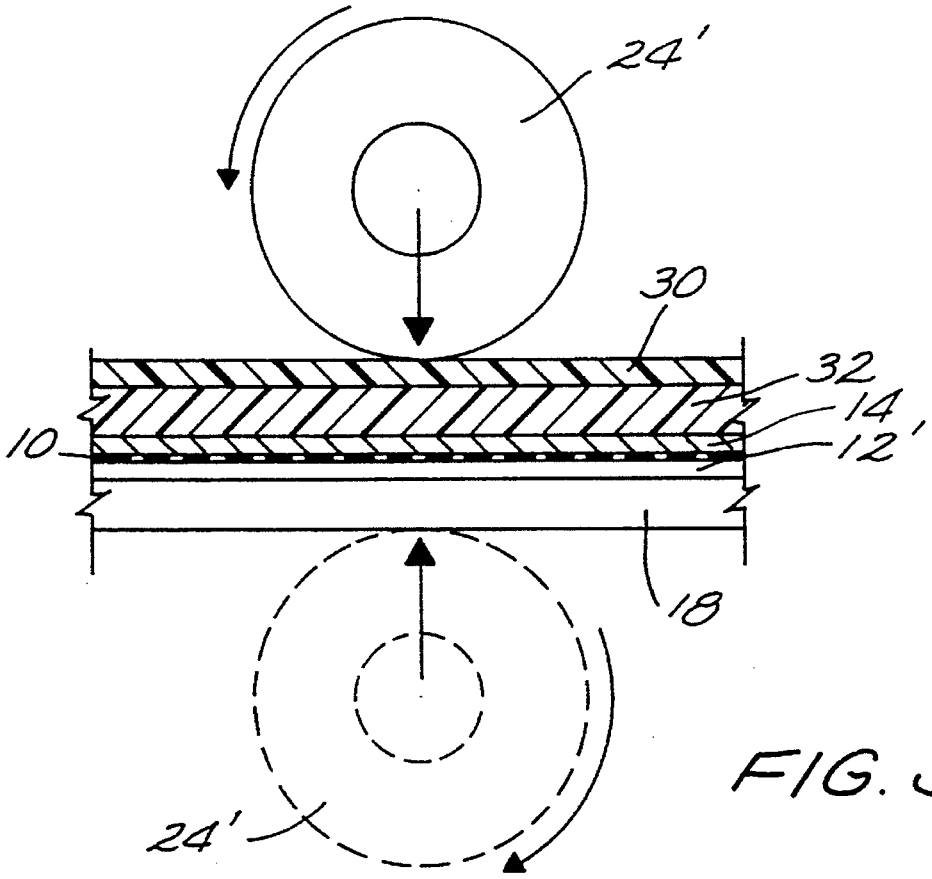
FIG. 3 is a view similar to that of FIG. 2, depicting an alternate embodiment for transferring the liquid toner image to the print medium.

In an alternate embodiment, depicted in FIG. 3, the non-conforming layer 30 and the conforming layer 32 may be provided such that the conforming layer supports the image receiver 14 and the non-conforming layer supports the conforming layer. Further, the heat and pressure may come from the roller 24' on the image receiver side, as shown in solid line, or on the side of the PC layer 18, as shown in phantom.

Figure 4:
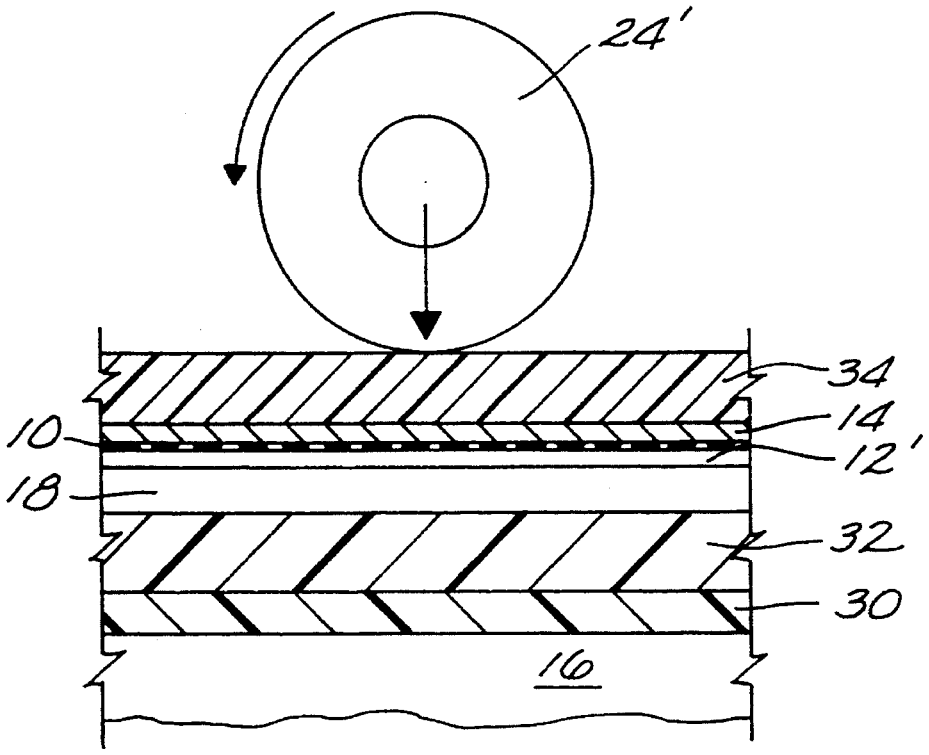
FIG. 4 is a view similar to that of FIG. 2, depicting yet another embodiment for transferring liquid toner to the print medium.

In yet another embodiment, the one-step process of the present invention may be employed to transfer the toner image 10 to the paper 14 by inserting a second conformable layer 34 between the heat and pressure roller 24' and the paper, as shown in FIG. 4.

Thus, the image receiver 14/image carrier 18 set is intercalated (sandwiched) between a heat/pressure means (e.g., roller 24') and at least one conformable layer 32. Either one conformable layer 32 or two conformable layers 32, 34 may be employed. However, greater contact is obtained using the two conformable layer approach depicted in FIG. 4, and that embodiment is accordingly preferred.

The material comprising the conformable layer 32, 34 is to be distinguished from the material comprising the non-conformable layer 30. A durometer value in the range of about 20 to 60 (Shore A) characterizes a conformable material suitably employed in the practice of the present invention, while a durometer value in the range of about 30 to 40 (Shore D) characterizes a non-conformable material suitably employed in the practice of the present invention. Exemplary conformable materials include silicone rubber, polyurethane, and neoprene. Exemplary non-conformable materials include polystyrene, polycarbonate, or other non-rubbery materials.

The thickness of the conformable layers 32, 34 is in the range of about 10 to 30 mils (0.25 to 0.76 mm). If the thickness is less than about 10 mils, the conformable layer will not have sufficient thickness to withstand repeated cycling. If the thickness is greater than about 30 mils, then there is insufficient heat transfer through the conformable layer to transfer the toner image 10 to the image receiver 14.

The image receiver 14, may comprise plain paper or other flexible substrate, including transparency stock (e.g., Mylar). The apparatus and method of the invention permit use of such image receivers, thereby avoiding the necessity of using specially coated paper, which is required in the prior art procedures.

The surface of the image receiver 14 that is used in the practice of the present invention is rougher than that of the prior art specially coated papers, typically having a roughness of about 150 to 180 Sheffield units (in contrast, specially coated papers typically have a roughness of about 30 to 50 Sheffield units). Moreover, the glass transition temperature of the image receiver 14 is greater than about 50° C., which is higher than that employed in the prior art specially coated papers, which tends to be near 20° C.

The release layer 12' comprises a siloxane or a perfluoro polymer. The siloxane is specifically polydimethyl siloxane or the copolymer derivatives of polydimethyl siloxane, given by the formula

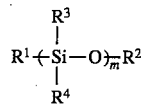

where $R^1$ and $R^2$ are independently single bond, hydrogen, alkyl (e.g., $—CH_3$), fluorinated alkyl (e.g., $—CH_2CF_3$), allyl (e.g., $—CH=CH_2$), aryl (e.g., $—C_6H_5$), hydroxy, alkoxy (e.g., $—CH_2OH$), and amine (e.g., $—NH_2$) and where $R^2$ can alternately be

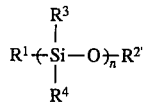

and $R^{2'}$, $R^3$, and $R^4$ are independently hydrogen, alkyl (e.g., $—CH_3$), fluorinated alkyl (e.g., $—CH_2CF_3$), allyl (e.g., $—CH=CH_2$), aryl (e.g., $—C_6H_5$), hydroxy, alkoxy (e.g., $—CH_2OH$), and amine (e.g., $—NH_2$) and where the sum of m+n is sufficient to provide a molecular weight of about 10,000 to 1,000,000.

Specific examples of such siloxanes include:

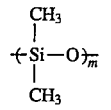

(1) polydimethyl siloxane

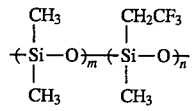

(2) fluoro silicone resin

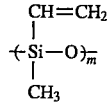

(3) vinyl silicone resin

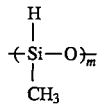

(4) polymethyl hydrosiloxane

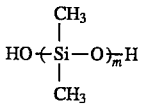

(5) silanol-terminated polydimethyl siloxane

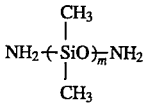

(6) amino-terminated polydimethyl siloxane

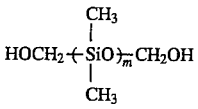

(7) carbinol-terminated polydimethyl siloxane

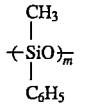

(8) polymethylphenyl siloxane

-continued

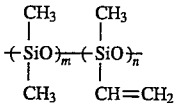

(9) copolymer of polydimethyl siloxane and vinyl silicone

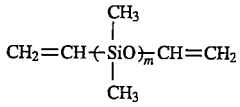

(10) divinyl-terminated polydimethyl siloxane

In the foregoing formulae (1)–(10), the sum of m+n is such as to provide a molecular weight in the range of about 10,000 to 1,000,000, as indicated above.

The perfluoro polymer derivatives include polymers of the formula $$R—(—CF_2CF_2O—)_p—(—CF_2O—)_qR,$$

where R=—$CH_2OH$ (diol) or —OC(O)—CH=CH (diacrylate) and where the sum of p+q is sufficient to provide a molecular weight of at least about 40,000.

The release surface coating 12' of the dimethyl siloxane polymers is prepared by a crosslinking reaction between varieties of polydimethyl siloxanes and crosslinkers. Examples of suitable crosslinkers include (1) diisocyanates (aliphatic, aromatic, low molecular weight or high molecular weight), for example by Desmondar CB-75 or N-75 products from Mobay Chemical, (2) phenolic resin, (3) melamine resin, (3) polymethyl hydro siloxane, and other suitable crosslinkers. The release coating 12', whether polydimethyl siloxane or perfluoro polymer, may contain certain types of fillers to enhance the wear-resistance of the release surface. These fillers include silica ($SiO_2$), treated silica, alumina ($Al_2O_3$), titanium dioxide ($TiO_2$), and other metal oxide powders which exhibit a bulk resistivity in the range $<10^8$ Ω-μm.

The crosslinking reaction of the release surface coating on the photoconductor is carried out in the normal range of thermal curing temperatures. This range can be from room temperature up to 300° C., whatever is suitable for photoconductor performance. The curing temperature range can also depend on the catalyst added into the crosslinking system of the polydimethyl siloxanes, such as platinum catalysts, benzoyl peroxide catalyst, zinc catalysts, tin catalysts.

Use of the perfluoro polymer derivatives for the release coating 12' merely requires heating the monomer at a temperature in the range of about 135° to 225° C., and preferably in the range of about 180° to 210° C., for a period of time of about 5 to 10 seconds to form the polymer.

The preferred release layer 12' has a surface energy less than about 40 dynes/cm. If the surface energy is greater than about 40 dynes/cm, then there will be no transfer of the image onto the image receiver 14.

The binder employed with the toner 10 useful in the practice of the present invention must have a glass transition temperature, $T_g$, in the range of about −10° to 60° C. If the $T_g$ is lower than about −10° C., then the toner 10 will be too sticky to be useful, while if the $T_g$ is greater than about 60° C., then the toner will not soften enough under the temperature and pressure conditions, and no transfer will occur.

The liquid toner 10 comprises a mixture of at least one colorant, binder, and charge transfer agent in a liquid carrier. Such liquid toners and their compositions are well-known.

The material comprising the photoconductor layer 18 comprises any of the well-known photoconducting materials, including phthalocyanine pigments, other well-known organic photoconductors, and inorganic photoconductors, such as ZnO, CdO, CdS, Se, amorphous-Si, and $TiO_2$. Examples of suitable phthalocyanine pigments include, but are not limited to, the metal-free crystalline forms (α-, β-, τ-, and x-$H_2$-phthalocyanines), α-copper phthalocyanine, α-titanyl phthalocyanine, Y-titanyl phthalocyanine, amorphous titanyl phthalocyanine, α-tetra-fluorotitanyl phthalocyanine, α-haloindium phthalocyanines (halo=Cl, Br, I, F), α-vanadyl phthalocyanine, α-zinc phthalocyanine, β-zinc phthalocyanine, x-magnesium phthalocyanine, α-chloroaluminum phthalocyanine, and hydroxygallium phthalocyanine.

Three benefits are derived from the practice of the present invention:

(1) liquid toner, with particle size less than about 1 μm, is employed, which results in higher resolution than dry toner;

(2) plain paper can be used as the image receiver, thereby avoiding the use of special coated papers required in other processes; and (3) stronger adherence of the printed image on the image receiver is obtained, due to the removal of the liquid carrier prior to transfer and due to the use of the smaller particle size toner.

While the process of the present invention appears at first blush to be similar to the prior art non-electrostatic transfer process disclosed in U.S. Pat. No. 5,037,718 ('718), there are in fact many differences. Specifically, the '718 process is directed to the transfer of solid toner particles on the order of 3 to 5 μm onto special coated paper; no release layer is employed in the transfer. In contrast, the process of the present invention is directed to the transfer of liquid toner, in which the particle size is less than 1 μm, onto plain paper; a release agent is required in the transfer.

The process of the present invention is also an improvement over the Benny Landa process, in that it avoids transferring much liquid onto the imager receiver and in that it avoids emission of harmful vapors from the liquid carrier into the office environment. While the Benny Landa process uses electrostatic transfer of liquid toner, the process of the present invention uses heat and pressure (non-electrostatic) transfer of toner particles.

INDUSTRIAL APPLICABILITY

The direct transfer of liquid toner from a photoconductor to image receivers is expected to find use in electrophotographic printers.

Thus, there has been disclosed apparatus and process for the direct transfer of liquid toner from a photoconductor to paper or other image receiver in a simple, one-step procedure. It will be readily apparent to those skilled in this art that various changes and modifications of an obvious nature may be made without departing from the spirit of the invention, and all such changes and modifications are considered to fall within the scope of the invention, as defined by the appended claims.

What is claimed is:

1. Apparatus for transferring an image, derived from a liquid toner, from a photoconductor layer to an image receiver, comprising:

(a) said photoconductor layer having a release layer thereon;

(b) a roller spaced from said photoconductor layer;

(c) means for directing said image receiver between said photoconductor layer and said roller such that said image receiver contacts both said release layer and said roller;

(d) at least one conformable layer, supporting said photoconductor layer and said image receiver thereon; and (e) a source of heat and pressure against said image receiver for transferring said image from said photoconductor layer to said image receiver.

2. The apparatus of claim 1 wherein said photoconductor layer comprises a material selected from the group consisting of the organic and inorganic photoconductor materials.

3. The apparatus of claim 2 wherein said organic photoconductor material comprises a phthalocyanine pigment selected from the group consisting of metal-free crystalline forms of phthalocyanine (α-, β-, τ-, and x-$H_2$-phthalocyanines), α-copper phthalocyanine, α-titanyl phthalocyanine, Y-titanyl phthalocyanine, amorphous titanyl phthalocyanine, α-tetrafluorotitanyl phthalocyanine, α-haloindium phthalocyanines, α-vanadyl phthalocyanine, α-zinc phthalocyanine, β-zinc phthalocyanine, x-magnesium phthalocyanine, α-chloroaluminum phthalocyanine, and hydroxy gallium phthalocyanine.

4. The apparatus of claim 2 wherein said inorganic photoconductor material is selected from the group consisting of ZnO, CdO, CdS, Se, amorphous-Si, and $TiO_2$.

5. The apparatus of claim 1 wherein said release layer consists essentially of either a siloxane or derivative thereof or a perfluoro polymer and provides said photoconductor layer with a surface energy of less than 40 dynes/cm.

6. The apparatus of claim 5 wherein said siloxane comprises a polydimethyl siloxane having the formula $$R^1\left(\begin{array}{c}R^3\\|\\Si-O\\|\\R^4\end{array}\right)_m R^2$$

where $R^1$ and $R^2$ are independently single bond, hydrogen, alkyl, fluorinated alkyl, allyl, aryl, hydroxy, alkoxy, and amine and where $R^2$ can alternately be $$R^1\left(\begin{array}{c}R^3\\|\\Si-O\\|\\R^4\end{array}\right)_n R^{2'}$$

and $R^{2'}$, $R^3$, and $R^4$ are independently hydrogen, alkyl, fluorinated alkyl, allyl, aryl, hydroxy, alkoxy, and amine and where the sum of m+n is sufficient to provide a molecular weight of about 10,000 to 1,000,000.

7. The apparatus of claim 6 wherein said release layer consists essentially of a siloxane selected from the group consisting of polydimethyl siloxane, fluoro silicone resins, vinyl silicone resins, polymethyl hydrosiloxane, silanol-terminated polydimethyl siloxane, amino-terminated polydimethyl siloxane, carbinol-terminated polydimethyl siloxane, polymethyl phenylsiloxane, copolymer of polydimethyl siloxane and vinyl siloxane, and divinyl-terminated polydimethyl siloxane.

8. The apparatus of claim 5 wherein said perfluoro polymer has the formula $$R-(-CF_2CF_2O-)_p-(-CF_2O-)_qR,$$

where R=—$CH_2OH$ or —OC(O)—CH=CH and where the sum of p+q is sufficient to provide a molecular weight of at least about 40,000.

9. The apparatus of claim 1 wherein said at least one conformable layer comprises a material having a durometer within the range of about 20 to 60 (Shore A).

10. The apparatus of claim 9 wherein said said at least one conformable layer comprises a material selected from the group consisting of silicone rubber, polyurethane, and neoprene.

11. The apparatus of claim 9 wherein said at least one conformable material has a thickness within the range of about 10 to 30 mils (0.025 to 0.76 mm).

12. The apparatus of claim 1 wherein said liquid toner comprises a mixture of at least one colorant, at least one binder, and at least one charge transfer agent dispersed in a liquid carrier, said mixture having an average particle size of at most about 1 μm and said at least one binder having a glass transition temperature within the range of about −10° to 60° C.

13. The apparatus of claim 1 wherein said source of heat and pressure provides a temperature within the range of about 110° to 120° C. and a pressure within the range of about 115 to 120 psi (7.7 to 8.4 $Kg/cm^3$).

14. The apparatus of claim 1 wherein one conformable layer is employed, together with a non-conformable layer which supports said conformable layer.

15. The apparatus of claim 14 wherein said roller comprises said source of heat and pressure and wherein said conformable layer supports said photoconductor layer, said conformable layer in turn supported by said non-conformable layer formed on a web.

16. The apparatus of claim 14 wherein said source of heat and pressure is on that surface of said photoconductor opposite that on which said toner image is carried and wherein said conformable layer is positioned between said roller and said image receiver, said non-conformable layer positioned between said roller and said conformable layer.

17. The apparatus of claim 14 wherein said non-conformable layer has a durometer value within the range of about 30 to 40 (Shore D).

18. The apparatus of claim 17 wherein said non-conformable layer comprises a material selected from the group consisting of polystyrene, polycarbonate, and non-rubbery materials.

19. The apparatus of claim 1 wherein two conformable layers are employed, with a first conformable layer supporting said photoconductor layer and a second conformable layer positioned between said roller and said image receiver, with a non-conformable layer supporting said first conformable layer.

20. The apparatus of claim 19 wherein said roller comprises said source of heat and pressure.

21. The apparatus of claim 19 wherein said non-conformable layer has a durometer value within the range of about 30 to 40 (Shore D).

22. The apparatus of claim 21 wherein said non-conformable layer comprises a material selected from the group consisting of polystyrene, polycarbonate, and non-rubbery materials.

23. The apparatus of claim 1 wherein said image receiver has a surface roughness of at least about 150 Sheffield units or a glass transition temperature of at least about 50° C. or both.

24. The apparatus of claim 1 further including:

(a) a liquid toner reservoir containing said liquid toner comprising liquid carrier and toner particles; and (b) means for transferring toner particles from said liquid toner reservoir to said photoconductor layer coated with said release layer, including means for removing liquid carrier from said liquid toner to provide said toner particles.

25. A method of transferring an image, derived from a liquid toner, formed on a surface of a photoconductor layer to an image receiver, comprising:

(a) providing said photoconductor layer with a release layer thereon;

(b) locating a roller spaced from said photoconductor layer;

(c) directing said image receiver between said photoconductor layer and said roller such that said image receiver contacts both said release layer and said roller;

(d) providing at least one conformable layer, supporting said photoconductor layer and said image receiver thereon; and (e) applying heat and pressure against said image receiver to transfer said image from said photoconductor layer to said image receiver.

26. The method of claim 25 wherein liquid toner comprises toner particles having a particle size of less than about 1 μm suspended in a liquid carrier and wherein said image on said surface of said photoconductor material comprises toner particles, produced by removing said liquid carrier prior to forming said image on said surface of said photoconductor layer.

* * * * *